US012392210B2

(12) United States Patent
Powell et al.

(10) Patent No.: US 12,392,210 B2
(45) Date of Patent: Aug. 19, 2025

(54) BATTERY POWERED DOWNHOLE CUTTING TOOL

(71) Applicant: Halliburton Energy Services, Inc., Houston, TX (US)

(72) Inventors: Bryan D. Powell, Carrollton, TX (US); Gerard Steven Mackay, Carrollton, TX (US); Christian Weliyanto, Carrollton, TX (US); Matthew Mlcak, Alvarado, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/227,426

(22) Filed: Jul. 28, 2023

(65) Prior Publication Data

US 2025/0034962 A1 Jan. 30, 2025

(51) Int. Cl.
*E21B 29/00* (2006.01)

(52) U.S. Cl.
CPC ..... *E21B 29/005* (2013.01)

(58) Field of Classification Search
CPC ..... E21B 29/005
See application file for complete search history.

(56) References Cited

U.S. PATENT DOCUMENTS 4,675,259 A * 6/1987 Totty ..... E21B 41/0085 429/157
6,868,901 B2 3/2005 Mason et al.
2002/0150436 A1* 10/2002 Mason ..... E21B 29/005 409/143
2006/0231258 A1 10/2006 Head et al.
2007/0131410 A1 6/2007 Hill et al.
2007/0221417 A1* 9/2007 Hall ..... E21B 4/06 175/415

(Continued)

FOREIGN PATENT DOCUMENTS

EP 4095347 A1 11/2022
WO 2017153168 A2 9/2017

OTHER PUBLICATIONS

International Search Report and Written Opinion for International Patent Application No. PCT/US2023/030502 dated Apr. 17, 2024. PDF file. 8 pages.

*Primary Examiner* — Kristyn A Hall
(74) *Attorney, Agent, or Firm* — John Wustenberg; C. Tumey Law Group PLLC

(57) ABSTRACT

A downhole cutting tool may include a tubular housing securable to a downhole end of a conveyance and a cutting head secured to the tubular housing. The cutting head may have a retractable cutting blade configured to move between a radially extended position and a retracted position. Additionally, the cutting head may be configured to rotate with respect to the tubular housing to drive the retractable cutting blade, in the radially extended position, to cut a downhole tubular disposed in a wellbore. The downhole cutting tool may also include at least one motor secured within the tubular housing and configured to drive rotation of the cutting head. Further, the downhole cutting tool may include a power source disposed within the tubular housing and configured to supply power to the at least one motor, and the power source may include at least one battery.

19 Claims, 6 Drawing Sheets

(56) References Cited

U.S. PATENT DOCUMENTS

| | | | | |
|---|---|---|---|---|
| 2010/0258289 | A1* | 10/2010 | Lynde | E21B 37/02 166/55.7 |
| 2014/0138091 | A1 | 5/2014 | Fuhst | |
| 2021/0387269 | A1 | 12/2021 | McAllister | |
| 2022/0341272 | A1* | 10/2022 | Andersen | E21B 29/005 |
| 2022/0412179 | A1 | 12/2022 | Sheiretov et al. | |

* cited by examiner

BATTERY POWERED DOWNHOLE CUTTING TOOL

BACKGROUND

Downhole cutting tools are generally used to recover tubing (e.g., downhole tubulars) from old wells by cutting or parting the tubing at a predetermined location in the wellbore. That is, once the tubing is cut, the portion of the tubing disposed above the cut may be retrieved from the wellbore. Downhole cutting tools may include various types of cutting tools such as explosive, chemical, or mechanical cutters. Generally, explosive and chemical cutters are high risk and require numerous safety measures. As such, mechanical cutters are generally preferred over explosive and chemical cutters. However, mechanical cutters require electrical power to operate. As such, mechanical cutters are generally run-in-hole via a powered conveyance such as a wireline. Unfortunately, using a wireline to power the downhole cutting tools requires surface power, which may not be available at some wellbores.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein are systems and methods for cutting downhole tubulars. In particular, example embodiments may include a downhole cutting tool that is lowered into the wellbore, via a conveyance, to a predetermined position in a wellbore. Using a power source disposed within the downhole cutting tool, the downhole cutting tool is configured to deploy a retractable anchor assembly to restrain axial movement of the downhole cutting tool along the wellbore. Further, using the power source, the downhole cutting tool is configured to rotate a cutting head having a retractable cutting blade to cut the downhole tubular. Powering the downhole cutting tool exclusively with the onboard power source (e.g., the power source disposed in the downhole cutting tool may permit the downhole tool to be run-in-hole via a powerless conveyance such as a slickline.

Figure 1:
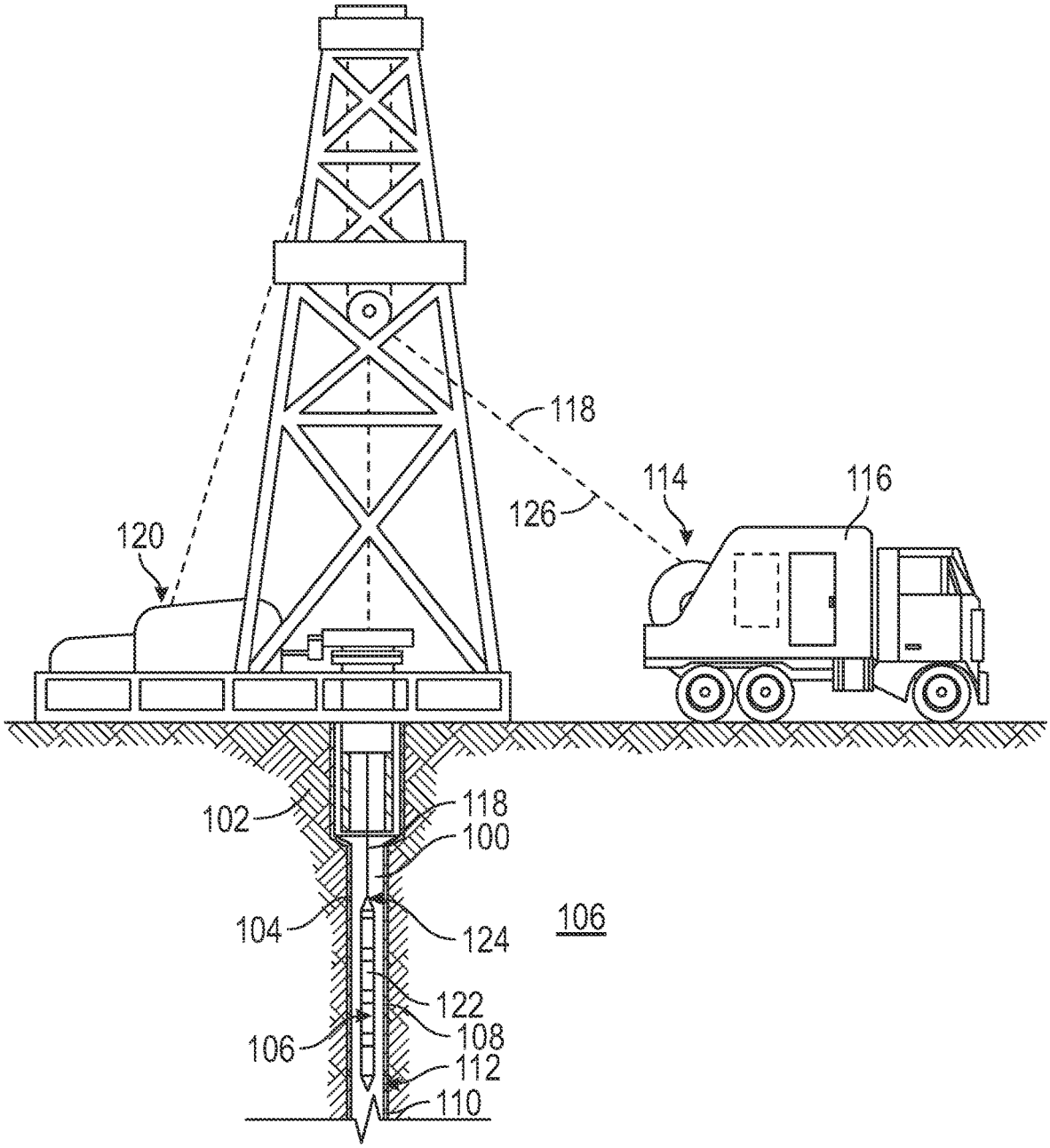
FIG. 1 illustrates an elevation view of a downhole cutting tool on a conveyance, in accordance with some embodiments of the present disclosure.

FIG. 1 illustrates an elevation view of a downhole cutting tool on a conveyance, in accordance with some embodiments of the present disclosure. As illustrated, a wellbore 100 may extend through subterranean formation 102. During drilling and/or completion operations, a downhole tubular 104 (e.g., casing, tubing, liner, packer mandrel, etc.) may be disposed within the wellbore 100. However, after abandonment, a downhole cutting tool 106 may partition the downhole tubular 104 such that an upper portion 108 of the downhole tubular 104 may be recovered/retrieved from the wellbore 100. In particular, a downhole cutting tool 106 may be lowered into the wellbore 100, via a conveyance 118, to a predetermined location to cut the downhole tubular 104 and partition the upper portion 108 (e.g., a portion of the downhole tubular 104 disposed above the cut 112) from a lower portion 110 of the downhole tubular 104. Once the downhole tubular 104 is cut, the downhole cutting tool 106 may be pulled out of the wellbore 100 and a retrieval tool (now shown) may be lowered into the wellbore 100 to secure and recover the upper portion 108 of the downhole tubular 104.

As illustrated, a hoist 114 may be used to run the downhole cutting tool 106 into wellbore 100. In particular, the hoist 114 may be disposed on a vehicle 116 and may be used to raise and lower the downhole cutting tool 106. While the hoist 114 is shown on the vehicle 116, it should be understood that the conveyance 118 may alternatively be disposed from a hoist 114 that is installed at surface 120 instead of being located on vehicle 116. The hoist 114 may be configured to raise and/or lower the conveyance 118 with respect to the wellbore 100. Further, the downhole cutting tool 106 has a tubular housing 122 securable to a downhole end 124 of the conveyance 118, such that the downhole cutting tool 106 may be run-in-hole or pulled-out-of-hole as the hoist 114 raises and/or lowers the conveyance 118 with respect to the wellbore 100.

Moreover, as set forth in greater detail below, the downhole cutting tool 106 includes a power source (shown in FIG. 2) disposed within the tubular housing 122 and configured to supply power to components of the downhole cutting tool 106. The components of the downhole cutting tool 106 may be independently powered by the power source secured within the tubular housing 122. For example, as illustrated, the conveyance 118 may include a slickline 126 or digital slickline configured to lower the downhole cutting tool 106 into the wellbore 100. Slicklines do not include wiring for transmitting electricity. As such, the power source may exclusively provide electricity to power the components of the downhole cutting tool 106. Alternatively, the conveyance 118 may include a wireline, coiled tubing, drill pipe, or other suitable conveyance 118 having wiring to provide electricity from the surface 120 to the downhole cutting tool 106 such that power may be supplied to the components of the downhole cutting tool 106 via a combination of the power source disposed in the tubular housing 122 and power supplied from the surface 120 via the conveyance 118.

Figure 2:
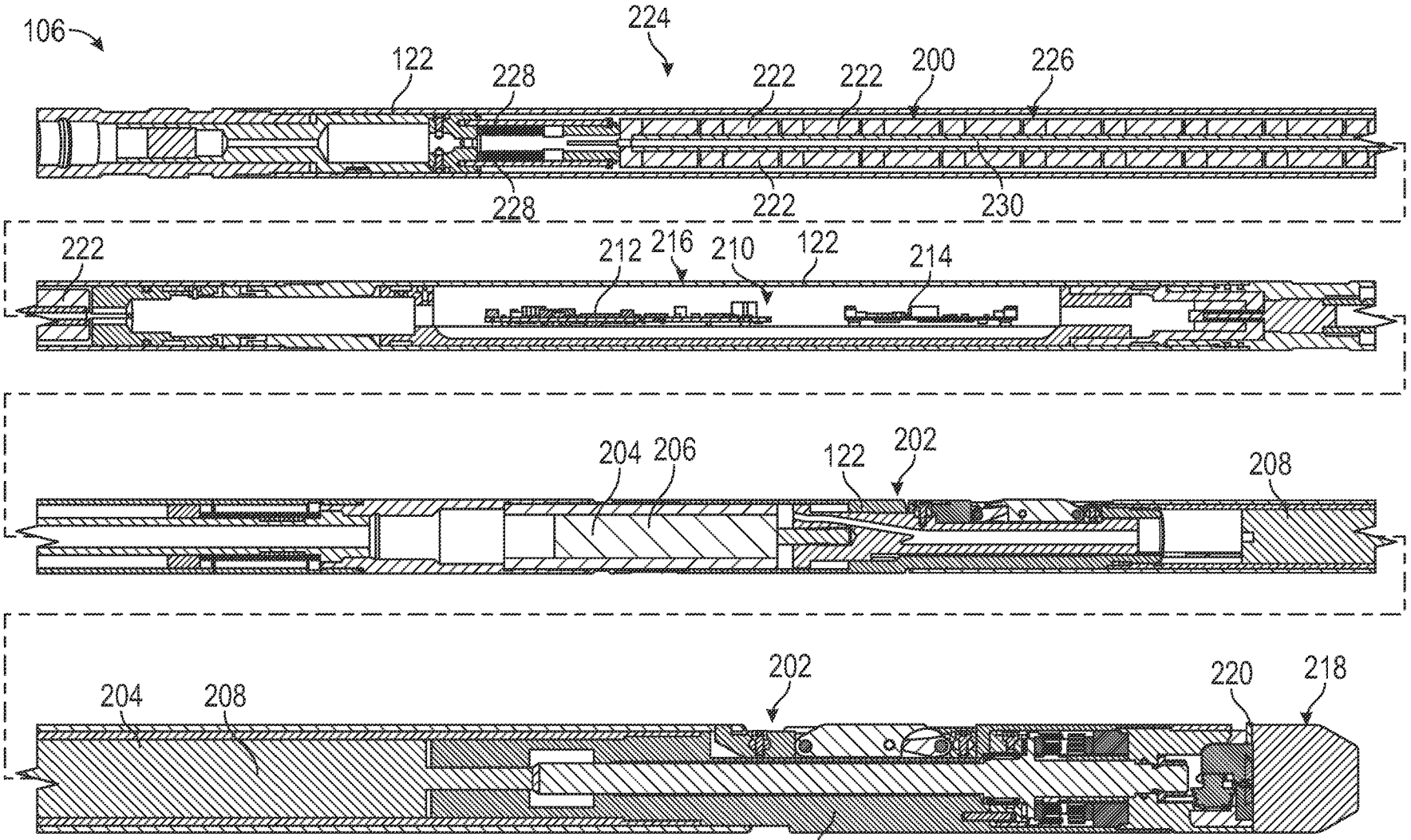
FIG. 2 illustrates a cross-sectional view of the downhole cutting tool, in accordance with some embodiments of the present disclosure.

FIG. 2 illustrates a cross-sectional view of a downhole cutting tool, in accordance with some embodiments of the present disclosure. The downhole cutting tool 106 includes the tubular housing 122 securable to the downhole end 124 of the conveyance 118 (shown in FIG. 1). Additionally, the downhole cutting tool 106 includes the power source 200 configured to provide power (e.g., electricity) to various components of the downhole cutting tool 106. As set forth above, the power source 200 may exclusively provide power to the various components of the downhole cutting tool 106. For example, some wells may not have power available at the surface or using powered conveyances (e.g., wireline, etc.) at such wells may be inconvenient. As such, the downhole cutting tool 106 may be lowered into the wellbore 100 (shown in FIG. 1) via a non-powered conveyance 118 (e.g., a slickline), and the power source 200 disposed within the downhole cutting tool 106 may provide power to the various components of the downhole cutting tool 106 (shown in FIG. 1). Alternatively, the power source 200 may provide power to the various components in combination with surface power source 620 supplying power to the downhole cutting tool 106 via a powered conveyance.

Moreover, the downhole cutting tool 106 may include a retractable anchor assembly 202 secured to the tubular housing 122. The retractable anchor assembly 202 is configured to extend radially outward at a predetermined position in a wellbore 100 to restrain movement of the tubular housing 122 along the wellbore 100. The retractable anchor assembly 202 may also be configured to centralize the downhole cutting tool 106 in the wellbore 100. Further, the downhole cutting tool 106 may include at least one motor 204 secured within the tubular housing 122. The at least one motor 204 may be an electrical motor configured to operate using power supplied from the power source 200 disposed within the downhole cutting tool 106. Moreover, as illustrated, the downhole cutting tool 106 may include a first motor 206 and a second motor 208. However, the downhole cutting tool 106 may include any suitable number of motors. For example, the downhole cutting tool 106 may additionally include a third motor (not shown). The first motor 206 may be configured to drive the retractable anchor assembly 202 to deploy and retract. As set forth in greater detail below, the first motor 206 is configured to drive the retractable anchor assembly 202 to extend radially outward in response to receiving an output from a control system 210 disposed within the tubular housing 122. Specifically, the control system 210 may include one or more control boards (e.g., a first control board 212 and a second control board 214) disposed within an electronics section 216 of the tubular housing 122.

The downhole cutting tool 106 may additionally include a cutting head 218 rotatably secured to the tubular housing 122. The cutting head 218 has a retractable cutting blade 220 configured to move between a radially extended position and a retracted position. As set forth in greater detail below, the cutting head 218 may be configured to rotate with respect to the tubular housing 122 to drive the retractable cutting blade 220 to cut the downhole tubular 104 disposed in the wellbore 100 (shown in FIG. 1). Further, the at least one motor 204 (e.g., the second motor 208) may be configured to drive rotation of the cutting head 218. In particular, the control system 210 of the downhole cutting tool 106 may be configured to direct the second motor 208 to rotate the cutting head 218 in a first direction in response to determining that the retractable anchor assembly 202 is deployed (e.g., disposed in the radially extended position). Additionally, the control system 210 may be configured to direct the at least one motor 204 to rotate the cutting head 218 in a second direction in response to determining that the retractable cutting blade 220 completed cutting the downhole tubular 104. Rotating the cutting head 218 in the second direction may move the retractable cutting blade 220 radially inward from the radially extended position to the retracted position as illustrated. Alternatively, the third motor may be configured to move the retractable cutting blade 220 radially between the extended position and the retracted position. Further, after completing the cut on the downhole tubular 104 and retracting the retractable cutting blade 220, the control system 210 may further direct the first motor 206 to rotate in a second direction to retract the retractable anchor assembly 202 such that the downhole cutting tool 106 may be pulled out-of-hole.

Moreover, as set forth above, the at least one motor 204 (e.g., the first motor 206 and the second motor 208) may operate using power supplied by the power source 200 disposed within the tubular housing 122. Further, the power source 200 may be configured to supply power to other components of the downhole cutting tool 106. For example, the power source 200 may be configured to supply power to the control system 210 of the downhole cutting tool 106, which may include various electrical components. Moreover, the power source 200 may include at least one battery 222 secured within a battery section 224 of the tubular housing 122. As illustrated, the at least one battery 222 includes a plurality of alkaline batteries, or other suitable batteries, arranged in series and in parallel within the battery section 224 of the tubular housing 122. Other suitable batteries 222 may include nickel metal hydride (Nimh) batteries, lithium batteries, triple-A batteries, or some combination thereof.

Additionally, the battery section 224 of the tubular housing 122 may include a battery cavity 226 for holding the plurality of batteries 222 in desired parallel and series configurations. The battery cavity 226 may be sized and shaped based on the type of batteries 222 used, such that the battery cavity 226 may be configured to hold a sufficient number of batteries 222 required for providing power to the various components of the downhole cutting tool 106 for the downhole tubing cutting process. Additionally, the battery section 224 may include battery springs 228 to bias the batteries 222 against each other such that batteries 222 maintain contact with each other during the downhole tubing cutting process. Further, the battery section 224 may include a wire passage 230 configured to house wires (not shown) for electrically connecting the batteries 222 to the various components of the downhole cutting tool 106.

Figure 3:
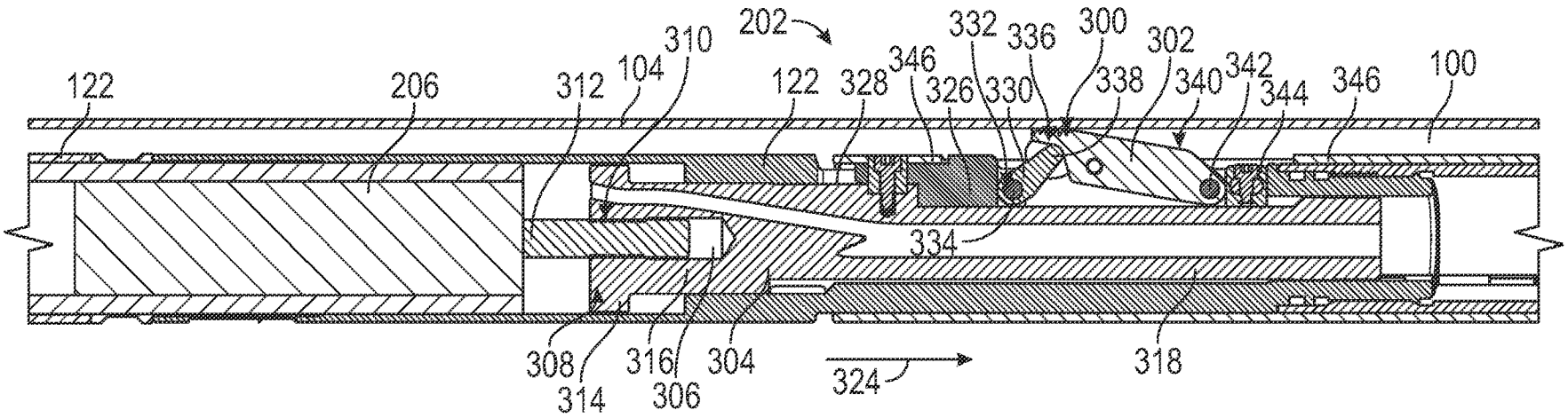
FIG. 3 illustrates a cross-sectional view of a retractable anchor assembly of the downhole cutting tool, in accordance with some embodiments of the present disclosure.

FIG. 3 illustrates a cross-sectional view of a retractable anchor assembly of the downhole cutting tool, in accordance with some embodiments of the present disclosure. As set forth above, the retractable anchor assembly 202 is configured to extend radially outward at the predetermined position in the wellbore 100 to restrain movement of the tubular housing 122 along the wellbore 100. The retractable anchor assembly 202 may include a first anchor 300 and a second anchor (shown in FIG. 4). As illustrated, the first anchor 300 is deployed. That is, a first anchor pad 302 of the first anchor 300 is extended radially outward to contact the downhole tubular 104. Contact between the first anchor pad 302 and the downhole tubular 104 may restrain movement of the tubular housing 122 along the wellbore 100.

The first anchor 300 may include a shifting assembly 304 disposed within the tubular housing 122. As illustrated, the shifting assembly 304 has a threaded bore 306 formed in an upper end 308 of the shifting assembly 304. The threaded bore 306 is configured to interface with corresponding threads 310 of a motor shaft 312 of the first motor 206 (e.g., an electrical motor powered by the at least one battery 222). To deploy the first anchor 300, the first motor 206 may rotate the motor shaft 312 in a first direction in response to receiving an output from the control system 210. Due to the threaded interface between the threaded bore 306 of the shifting assembly 304 and the motor shaft 312, rotation of the motor shaft 312 in the first direction may drive the shifting assembly 304 to move axially away from the first motor 206. Similarly, rotation of the motor shaft 312 in the second direction (e.g., opposite the first direction) may drive the shifting assembly 304 axially toward the first motor 206.

Moreover, the shifting assembly 304 may have a stepped diameter with an upper end portion 314 of the shifting assembly 304 having a larger diameter than a middle portion 316 and/or lower end portion 318 of the shifting assembly 304 such that a shoulder 320 is formed at a transition between the upper end portion 314 and the middle portion 316. The shoulder 320 may be configured to contact a landing shoulder 322 formed on an inner surface 120 of the tubular housing 122 as the shifting assembly 304 moves axially away from the first motor 206 by a predetermined distance. As such, the landing shoulder 322 may limit the travel distance of the shifting assembly 304 in the downhole direction 324, which may restrain radial extension of the first anchor pad 302 to a desired extension distance.

The first anchor 300 may further include at least one mounting plate 326 rigidly secured to a radially outer surface 328 of the shifting assembly 304. As illustrated, the mounting plate 326 may be secured to the radially outer surface 328 of the middle portion 316 and/or the lower end portion 318 of the shifting assembly 304. However, the mounting plate 326 may be secured to any suitable portion of the shifting assembly 304. Additionally, the first anchor 300 may include at least one first anchor rod 330 and at least one first anchor pad 302. As illustrated, an upper end 332 of the first anchor rod 330 may be secured to the mounting plate 326 via a first upper hinged joint 334, an upper end 336 of the first anchor pad 302 may be secured to a lower end 338 of the first anchor rod 330 via a first middle hinged joint (not shown), and a lower end 340 of the first anchor pad 302 may be secured to the tubular housing 122 via a first lower hinged joint 342. However, the first anchor rod 330 and the first anchor pad 302 may be connected and secured in any suitable arrangement for deploying the first anchor 300. For example, the lower end 340 of the first anchor pad 302 may alternatively be secured, via the lower hinged joint 342, to a lower mounting plate 344 that is rigidly secured to the tubular housing 122.

Moreover, as the shifting assembly 304 moves axially away from the first motor 206, the upper end 332 of the first anchor rod 330 moves toward the lower end 340 of the first anchor pad 302, which is fixed to the tubular housing 122. As illustrated, moving the upper end 332 of the first anchor rod 330 toward the lower end 340 of the first anchor pad 302 drives the first anchor rod 330 and the first anchor pad 302 to hinge with respect to each other, via the various hinged joints. Further, hinging the first anchor rod 330 with respect to the first anchor pad 302 may move the upper end 336 of the first anchor pad 302 to extend radially outward with respect to the tubular housing 122 and contact the downhole tubular 104 as illustrated.

Further, the at least one mounting plate 326 may include a plurality of mounting plates secured about the radially outer surface 328 of the shifting assembly 304. For example, the first anchor 300 may include three mounting plates (e.g., a first mounting plate, a second mounting plate, and a third mounting plate) disposed about the shifting assembly 304. Each mounting plate 326 may have corresponding first anchor rods 330 and first anchor pads 302 such that deploying the first anchor 300 may extend a plurality of first anchor pads 302 radially outward with respect to the tubular housing 122 to engage the downhole tubular 104. Deploying the plurality of first anchor pads 302 may restrain axial movement of the downhole cutting tool 106 in the wellbore 100 while also keeping the downhole cutting tool 106 generally centralized in the wellbore 100.

Moreover, the downhole cutting tool 106 may also include a sliding sleeve 346 disposed proximate the first anchor 300. The sliding sleeve 346 may be rigidly connected to the sliding shifting assembly. Accordingly, axial downhole movement of the shifting assembly 304 to deploy the first anchor 300 may also drive the sliding sleeve 346 in the axially downhole direction 324. Thus, actuating the first motor 206 to deploy the first anchor 300 may also drive the sliding sleeve 346 in the axially downhole direction 324. As set forth in greater detail below, moving the sliding sleeve 346 in the axially downhole direction 324 may deploy the second anchor.

Figure 4:
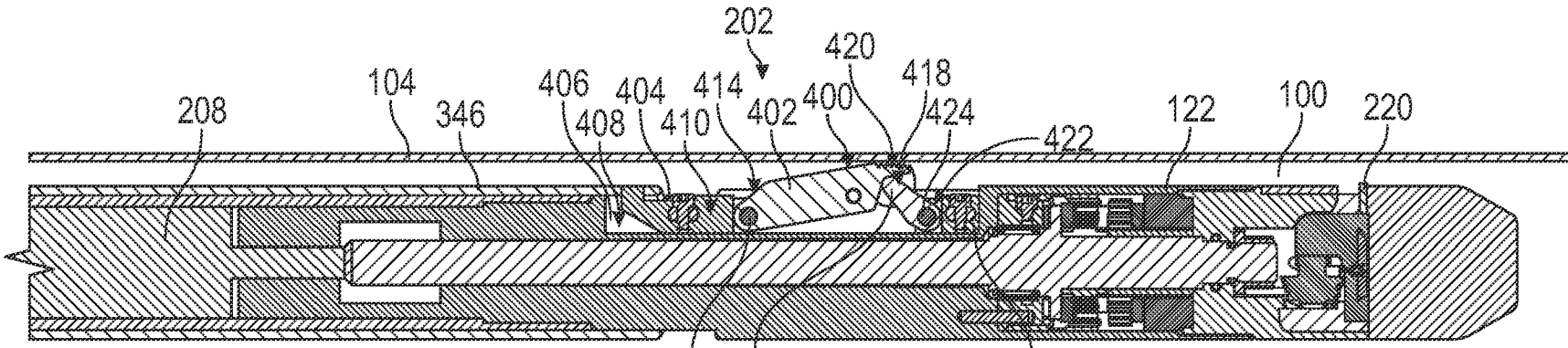
FIG. 4 illustrates a cross-sectional view of a second anchor of the retractable anchor assembly disposed in an extended position and a retractable cutting blade disposed in a retracted position, in accordance with some embodiments of the present disclosure.

FIG. 4 illustrates a cross-sectional view of a second anchor of the retractable anchor assembly disposed in an extended position and a retractable cutting blade disposed in a retracted position, in accordance with some embodiments of the present disclosure. As set forth above, the retractable anchor assembly 202 may include the second anchor 400, which is axially offset from the first anchor 300. In particular, the second anchor 400 may be disposed downhole from the first anchor 300 (shown in FIG. 3) in a position proximate to the cutting head 218. Prior to rotating the cutting head 218, the second anchor 400 may be deployed to help secure the downhole cutting tool 106. That is, at least one second anchor pad 402 of the second anchor 400 may be extended radially outward to contact the downhole tubular 104 in a second extended position. Contact between the at least one second anchor pad 402 and the downhole tubular 104 may help restrain movement of the tubular housing 122 along the wellbore 100 to secure the downhole cutting tool 106.

Moreover, the second anchor 400 may be deployed (e.g., actuated from a retracted position to the extended position) in response to actuation of the first anchor 300. As set forth above, deploying the first anchor 300 may drive the sliding sleeve 346 in the axially downhole direction 324. The second anchor 400 may include a sliding connector plate 404 secured to the sliding sleeve 346. As such, axial movement of the sliding sleeve 346 in the downhole direction 324 may drive the sliding connector plate 404 along a second anchor recess 406 from an upper plate position 408 to a lower plate position 410. Moving the sliding connector plate 404 to the upper plate position 408 may retract the second anchor 400 and moving the sliding connector plate 404 to the lower plate position 410 may deploy the second anchor 400 as illustrated.

The second anchor 400 may include at least one second anchor rod 412 and the at least one second anchor pad 402. As illustrated, an upper end 414 of the second anchor pad 402 may be secured to the sliding connector plate 404 via a second upper hinged joint 416, an upper end 418 of the second anchor rod 412 may be secured to a lower end 420 of the second anchor pad 402 via a second middle hinged joint (not shown), and a lower end 422 of the second anchor rod 412 may be secured to the tubular housing 122 via a second lower hinged joint 424. However, the second anchor rod 412 and the second anchor pad 402 may be connected and secured in any suitable arrangement for deploying the second anchor 400. For example, the lower end 338 of the first anchor rod 330 may alternatively be secured, via the second lower hinged joint 424, to a second lower mounting plate 426 that is rigidly secured to the tubular housing 122.

Moreover, as the sliding sleeve 346 moves axially downhole in response to the first anchor 300 being deployed, the sliding connector plate 404 moves axially downhole to drive the upper end 414 of the second anchor pad 402 toward the lower end 422 of the second anchor rod 412, which is fixed to the tubular housing 122. As illustrated, moving the upper end 414 of the second anchor pad 402 toward the lower end 422 of the second anchor rod 412 drives the second anchor pad 402 and the second anchor rod 412 to hinge with respect to each other, via the various hinged interfaces. Hinging the second anchor pad 402 with respect to the second anchor rod 412 may move the lower end 420 of the second anchor pad 402 to extend radially outward with respect to the tubular housing 122 and contact the downhole tubular 104.

Further, as illustrated, the retractable cutting blade 220 is disposed in a retracted position. The control system 210 (shown in FIG. 2) may be configured to hold the retractable cutting blade 220 in the retracted position until the retractable anchor assembly 202 (e.g., the first anchor 300 and the second anchor 400) is deployed. That is, the control system 210 may not direct power from the power source 200 to the second motor 208 until the control system 210 determines that the first motor 206 has driven the retractable anchor assembly 202 to deploy and secure the downhole cutting tool 106 against the downhole tubular 104 at the predetermined position in the wellbore 100.

Figure 5:
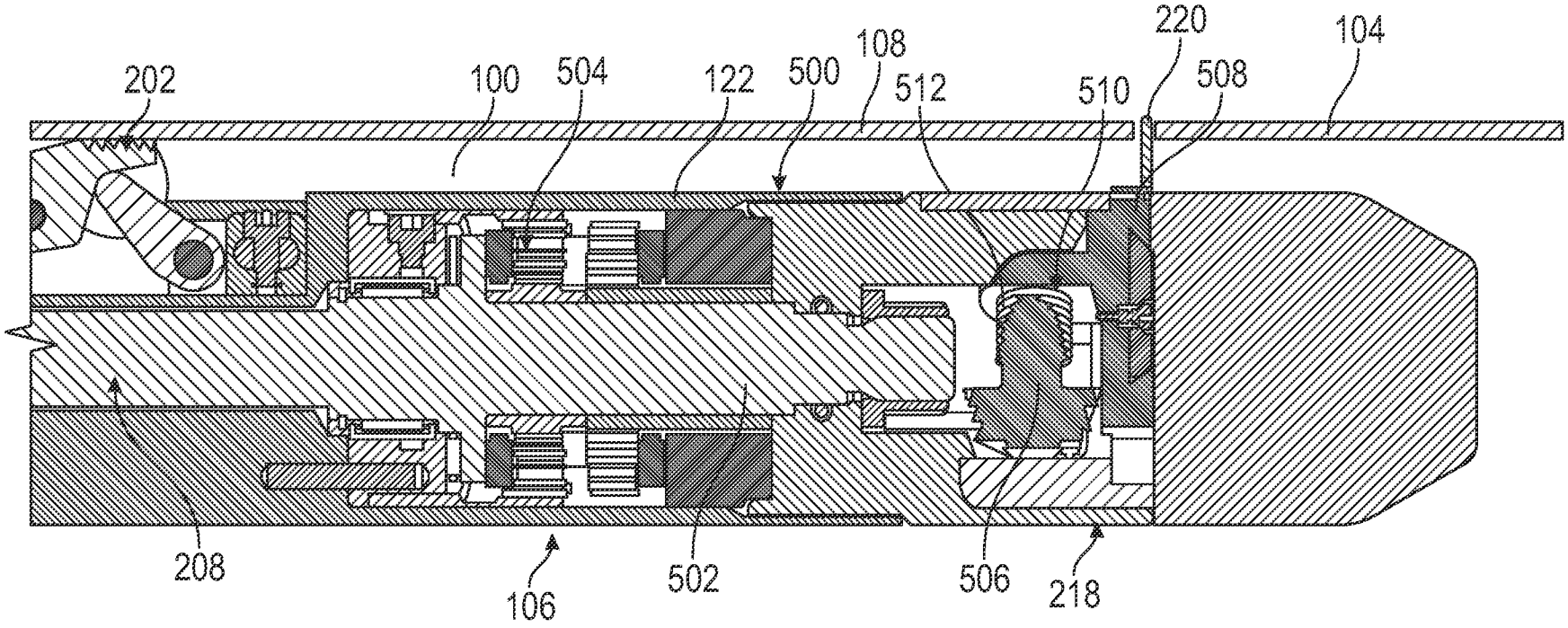
FIG. 5 illustrates a cross-sectional view of the cutting head having the retractable cutting blade extended radially outward to engage a downhole tubular, in accordance with some embodiments of the present disclosure.

FIG. 5 illustrates a cross-sectional view of the cutting head having the retractable cutting blade, in accordance with some embodiments of the present disclosure. As set forth above, the retractable cutting blade 220 may be configured to move between the retracted position and the radially extended position. As illustrated, the retractable cutting blade 220 is disposed in the radially extended position. That is, the retractable cutting blade 220 is extended radially outward to engage the downhole tubular 104. Once extended, continued rotation of the cutting head 218 may drive retractable cutting blade 220 to cut the downhole tubular 104 disposed in the wellbore 100.

Moreover, as illustrated, the cutting head 218 may be secured to a downhole end 500 of the tubular housing 122. In particular, the cutting head 218 is rotatably secured to tubular housing 122 such that the cutting head 218 may rotate with respect to the tubular housing 122 to drive the retractable cutting blade 220. As set forth above, the second motor 208 may be configured to drive rotation of the cutting head 218 in a first direction in response to the control system 210 (shown in FIG. 2) determining that the retractable anchor assembly 202 is disposed in the deployed position. The second motor 208 may include a drive shaft 502 configured to rotate in response to actuation of the second motor 208. The cutting head 218 may be connected to the drive shaft 502 such that rotation of the drive shaft 502 may rotate the cutting head 218. Further, the downhole cutting tool 106 may include a gear system 504 to control the direction of rotation of the cutting head 218. That is, the gear system 504 may allow the cutting head 218 to be selectively rotated in the first direction or a second direction. Rotation of the cutting head 218 in the first direction may extend the retractable cutting blade 220, and rotation of the cutting head 218 in a second direction may retract the retractable cutting blade 220.

The downhole cutting tool 106 may further include a feed gear 506 disposed within the cutting head 218. As illustrated, the feed gear 506 may be configured to move the retractable cutting blade 220 radially outward from the retracted position to the radially extended position in response to rotation of the cutting head 218 in a first direction. Further, the feed gear 506 is configured to move the retractable cutting blade 220 radially inward from the radially extended position to the retracted position in response to rotation of the cutting head 218 in a second direction. In particular, the retractable cutting blade 220 may be secured to a retractable base 508, and the retractable base 508 may include a threaded bore 510 configured to interface with the feed gear 506. That is, the feed gear 506 may include a threaded shaft 512 configured to rotate in response to rotation of the drive shaft 502 of the second motor 208. As the threaded shaft 512 of the feed gear 506 rotates, the retractable base 508 may move radially based at least in part on the orientation of the retractable base 508 in the cutting head 218 and the threaded interface between the feed gear 506 and the retractable base 508.

Moreover, as set forth above, the control system 210 may be configured to direct actuation of the second motor 208 to rotate the cutting head 218 in the first direction and extend the retractable cutting blade 220. However, in response to the control system 210 determining that the retractable cutting blade 220 completed cutting the downhole tubular 104, the control system 210 may be configured to direct the second motor 208 to rotate the cutting head 218 in the second direction to move the retractable cutting blade 220 radially inward and disengage the retractable cutting blade 220 from the downhole tubular 104. Further, in response to the control system 210 determining that the retractable cutting blade 220 is sufficiently retracted, the control system 210 may actuate the first motor 206 in reverse (e.g., in the second direction) to retract the retractable anchor assembly 202 such that the downhole cutting tool 106 may be pulled out-of-hole. As set forth above, once the downhole cutting tool 106 is pull-out-of hole, the upper portion 108 of the downhole tubular 104 may be recovered from the wellbore 100.

Figure 6:
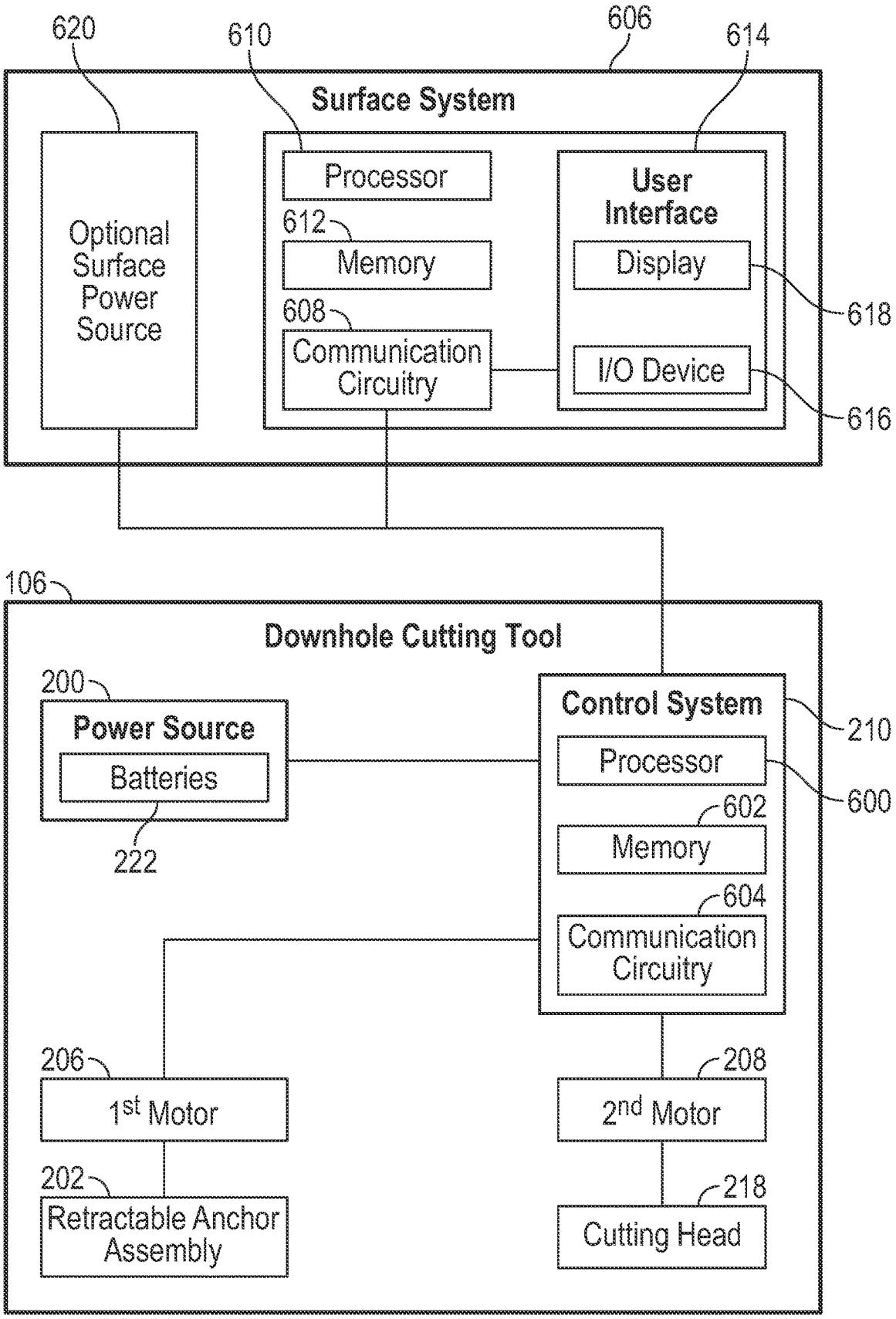
FIG. 6 illustrates a block diagram of a surface system and the downhole cutting tool, in accordance with some embodiments of the present disclosure.

FIG. 6 illustrates a block diagram of a surface system and the downhole cutting tool, in accordance with some embodiments of the present disclosure. As set forth above, the downhole cutting tool 106 may include the control system 210 having various electrical components for directing operations of the downhole cutting tool 106. For example, as illustrated, the control system 210 may include a processor 600 and a memory 602. The processor 600 may include one or more processing devices, and the memory 602 may include one or more tangible, non-transitory, machine-readable media. By way of example, such machine-readable media can include RAM, ROM, EPROM, EEPROM, or optical disk storage, magnetic disk storage or other magnetic storage devices, or any other medium which can be used to carry or store desired program code in the form of machine-executable instructions or data structures and which can be accessed by the processor 600 or by other processor-based devices (e.g., mobile devices). The memory 602 may be configured to store controller instructions executable by the processor 600 to output various control system signals. For example, the processor 600 may execute the controller instructions to actuate the first motor 206 and/or the second motor 208 during downhole tubular cutting operations. Additionally, the control system 210 may include multiple processors and memory devices. For example, the control system 210 may include the first control board 212 (shown in FIG. 2), having a first memory and a first processor, configured to direct operation of the first motor 206, and the second control board 214 (shown in FIG. 2), having a second memory and a second processor, configured to direct operation of the second motor 208. Indeed, the control system 210 may include any suitable configuration for directing downhole tubular cutting operations of the downhole cutting tool 106.

The control system 210 may also include any suitable hardware for monitoring voltage of the power source 200, current of the at least one motor 204, blade displacement, etc. during downhole tubular cutting operations. Voltage and current data may indicate an operational status of the downhole cutting tool 106. For example, the power source 200 may provide power to the first motor 206 to deploy the retractable anchor assembly 202 and to the second motor 208 to rotate the cutting head 218. As the retractable cutting blade 220 engages the downhole tubular 104, the power source 200 may output more power to the second motor 208 to maintain rotation of the cutting head 218 as the retractable cutting blade 220 cuts through the downhole tubular 104 (shown in FIG. 5). As such, the voltage and current data, showing a maintained increase in power usage to the second motor, may be indicative of the operational status of the downhole cutting tool (e.g., that the downhole cutting tool is actively cutting through the downhole tubular 104). Further, after completing the cut through the downhole tubular 104, the power source 200 may output less power to the second motor 208 to maintain rotation of the cutting head 218 since the cutting head 218 no longer requires additional power to drive the retractable cutting blade 220 through the downhole tubular 104. As such, the voltage and current data showing a decrease in power usage to the second motor may be indicative of another operational status of the downhole cutting tool (e.g., that the downhole cutting tool finished cutting the downhole tubular 104) . . . . Thus, based on the voltage and current changes and/or levels corresponding to the power outputted to the first motor 206 and/or the second motor 208, the operational status of the downhole cutting tool 106 may be determined.

The control system 210 may further include communication circuitry 604 configured to both send and receive data and/or instructions during downhole tubular cutting operations. Using the communication circuitry 604, the control system 210 may communicate/output the operational status of the downhole cutting tool 106 and/or other data to a surface system 606. Additionally, the control system 210 may be configured to receive instructions from the surface system 606 via the communication circuitry 604. For example, the control system 210 may output the voltage and current data, as well as blade displacement data, via the communication circuitry 604, to a corresponding surface communication circuitry 608 of the surface system 606. The surface system 606 may include a user interface 614 configured to display the voltage and current data, as well as the blade displacement data. Based at least in part on the displayed voltage and current data and/or blade displacement data, an operator may determine the operational status of the downhole cutting tool 106 and output, via the user interface 614, instructions to the control system 210 to actuate the first motor 206 and/or the second motor 208 (e.g., to transition the downhole cutting tool 106 from an anchor state to a cutting state). As such, the control system may actuate the first motor 206 and/or the second motor 208 in response to receiving instructions output based on the determined operational status of the downhole drilling tool 106.

For example, the surface system 606 may output instructions for the downhole cutting tool 106 to deploy the retractable anchor assembly 202 in response to a user determining that the downhole cutting tool 106 reached a desired location in the wellbore 100. Further, the surface system 606 may output instructions to rotate the cutting head 218, which may extend the retractable cutting blade 220 to engage and cut the downhole tubular 104 as set forth above. Further, in response to a user determining that the cut is complete, the surface system 606 may send instructions to disengage/retract the retractable cutting blade 220 and the retractable anchor assembly 202 such that the downhole cutting tool 106 may be pulled out-of-hole.

As set forth above, the surface system 606 may communicate with the control system 210 of the downhole cutting tool 106 via the surface communication circuitry 608. The surface communication circuitry 608 may include antennas, radio transceiver circuits, and signal processing hardware and/or software (e.g., hardware or software filters, A/D converters, multiplexers, amplifiers), or a combination thereof, and that may be configured to communicate over wired and/or wireless communication paths. Wire and or any other suitable communication medium may connect the surface communication circuitry 608 with the communication circuitry 604 of the downhole cutting tool 106.

The surface system 606 may also include at least one surface processor 610 and surface memory 612. Additionally, the surface system 606 may include the user interface 614 set forth above. The user interface 614 may include an input/output device 616 (e.g., keyboard, mouse, or touch screen) configured to provide the user input to the processor 600. Further, the user interface 614 may include a display 618 (e.g., computer monitor or personal device screen) configured to display user options for the surface system 606 as well as downhole data. Users may output instructions from the surface system 606 to the downhole cutting tool 106 via the user interface 614. For example, as set forth above, a user may view data output from the downhole cutting tool 106 (e.g., voltage data, current data, blade displacement data, etc.) to determine the operational status of the downhole cutting tool 106 (e.g., that the downhole cutting tool 106 has finished cutting the downhole tubular 104). In response, the user may use the input/output device 616 to send instructions from the surface system 606 to the downhole cutting tool 106 to rotate the cutting head 218, via the second motor 208, in the second direction to retract the retractable cutting blade 220. Further, the surface system 606 may output instructions to selectively actuate the first motor 206 or the second motor 208.

Alternatively, the downhole cutting tool 106 may be configured to operate autonomously. That is, the downhole cutting tool 106 may be configured to operate without instructions from the surface system 606. The control system 210 may include an internal timer. The control system 210 may be configured to autonomously direct the at least one motor 204 based at least in part on the internal timer. For example, the downhole cutting tool 106 may be run-in-hole on the conveyance 118. Based on the internal timer, the control system 210 may direct the at least one motor 204 (e.g., the first motor 206 and the second motor 208) to actuate after a predetermined amount of time. In particular, the first motor 206 may drive the retractable anchor assembly 202 to deploy at a first time based on the internal timer. Further, the second motor 208 may drive rotation of the cutting head 218 and extension of the retractable cutting blade 220 at a second time, after the first time, based on the internal timer. Alternatively, the first motor 206 and the second motor 208 may be directed to actuate simultaneously. Moreover, the control system 210 may monitor the current and/or voltage from the power source 200 to self-determine when the retractable cutting blade 220 completes the cut through the downhole tubular 104. In response to the control system 210 determining that the cut is complete, the control system 210 may then direct the first motor 206 and the second motor 208 to retract the retractable anchor assembly 202 and the retractable cutting blade 220, respectively.

Moreover, as set forth above, the at least one motor 204 (e.g., the first motor 206 and the second motor 208) may be independently powered by the power source 200 (e.g., the at least one battery) secured within the tubular housing 122. However, the power source 200 may alternatively operate in combination with a surface power source 620 to supply power to the downhole cutting tool 106. That is, the downhole cutting tool 106 may be run-in-hole via a powered conveyance 118 such as a wireline. The powered conveyance 118 may transmit/relay power from the surface power source 620 to the downhole cutting tool 106. The control system 210 may direct power from at least one battery 222 and the surface power source to operate the control system 210, the first motor 206, the second motor 208, and/or any other components of the downhole cutting tool 106.

Figure 7:
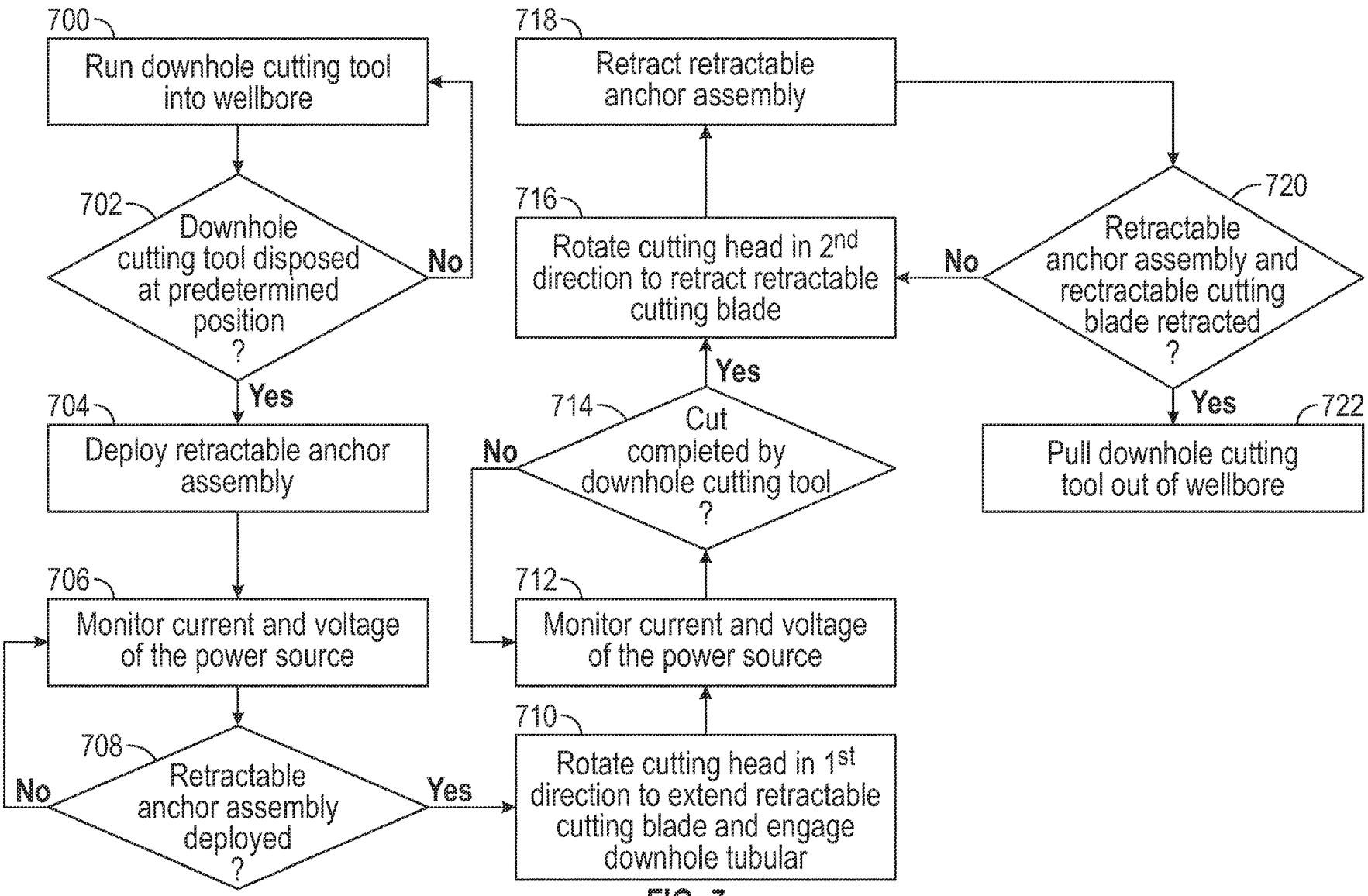
FIG. 7 illustrates a flow chart of the operation of the downhole cutting tool, in accordance with some embodiments of the present disclosure.

FIG. 7 illustrates a flow chart of the operation of the downhole cutting tool to cut a downhole tubular disposed in the wellbore, in accordance with some embodiments of the present disclosure. The downhole cutting tool may be run into the wellbore 700. As set forth above, the downhole cutting tool includes the tubular housing, the retractable anchor assembly, the rotating cutting head having the retractable cutting blade, the at least one motor (e.g., the first motor and the second motor), the control system, and the power source disposed in the downhole cutting tool.

Further, the control system and/or a user operating the surface system may determine if the downhole cutting tool has been run-in-hole to the predetermined position 702. For example, the user operating the surface system may monitor the location (e.g., depth) of the downhole cutting tool using measurements from an instrumented measure wheel. Further, the user may verify/correct the location of the downhole cutting tool using tubing collars detected by a collar locating tool while being run-in-hole. If the cutting tool has not been run-in-hole to the predetermined position, then the downhole cutting tool may continue to be run-in-hole. However, in response to the control system and/or the user operating the surface system determining that the downhole cutting tool is disposed at the predetermined position, the retractable anchor assembly may be deployed 704, via the at least one motor powered by the power source, to restrain movement of the tubular housing along the wellbore.

The power source (e.g., the voltage and current of the power source) may be monitored as the retractable anchor assembly is deployed 706. As set forth above, based on changes in the voltage and current of the power source, the control system and/or the user operating the surface system may determine whether the retractable anchor assembly is deployed 708. If not, the control system and/or the user operating the surface system will continue to monitor the power source. However, in response to the control system and/or the user operating the surface system determining that the retractable anchor assembly is deployed, the control system may direct the cutting head to rotate in the first direction 710, which may move the retractable cutting blade, via the feed gear, to the radially extended position to engage and cut the downhole tubular.

The power source (e.g., the voltage and current of the power source) may be monitored as the retractable cutting blade engages the downhole tubular 712. As set forth above, based on changes in the voltage and current of the power source, the control system and/or the user operating the surface system may determine whether the retractable cutting blade has completed the cut of the downhole tubular 714. If not, the control system and/or the user operating the surface system will continue to monitor the power source. However, in response to the control system and/or the user operating the surface system determining that the retractable cutting blade has completed the cut of the downhole tubular, the control system may direct the cutting head to rotate in the second direction 716, which may retract the retractable cutting blade. Further, the control system may retract the retractable anchor assembly to release the tubular housing to move along the wellbore 718. Moreover, in response to the control system and/or the user operating the surface system determining that the retractable anchor assembly and the retractable cutting blade are retracted 720, the downhole cutting tool may be pulled out of the wellbore 722.

Accordingly, the present disclosure may provide a downhole cutting tool configured to cut downhole tubulars via at least one motor powered by a power source disposed within a tubular housing of the downhole cutting tool. The systems and methods may include any of the various features disclosed herein, including one or more of the following statements.

Statement 1. A downhole cutting tool, comprising: a tubular housing securable to a downhole end of a conveyance; a cutting head secured to the tubular housing, the cutting head having a retractable cutting blade configured to move between a radially extended position and a retracted position, and wherein the cutting head is configured to rotate with respect to the tubular housing to drive the retractable cutting blade, in the radially extended position, to cut a downhole tubular disposed in a wellbore; at least one motor secured within the tubular housing and configured to drive rotation of the cutting head; and a power source disposed within the tubular housing and configured to supply power to the at least one motor, wherein the power source comprises at least one battery.

Statement 2. The downhole cutting tool of statement 1, wherein the at least one motor is independently powered by the at least one battery secured within the tubular housing.

Statement 3. The downhole cutting tool of statement 1 or statement 2, wherein the at least one battery comprises a plurality of batteries arranged in series and in parallel within a battery section of the tubular housing.

Statement 4. The downhole cutting tool of any preceding statement, wherein the at least one battery comprises at least one alkaline battery, nickel metal hydride (Nimh) battery, lithium battery, or some combination thereof.

Statement 5. The downhole cutting tool of any of statements 1, 3, and 4, wherein conveyance comprises a wireline configured to relay power from the surface, wherein the at least one battery and the wireline are configured to supply power to the at least one motor.

Statement 6. The downhole cutting tool of statements 1, 3, 4, and 5, wherein the conveyance comprises slickline, digital slickline, wireline, coiled tubing, drill pipe, or some combination thereof.

Statement 7. The downhole cutting tool of any preceding statement, further comprising a feed gear disposed within the cutting head, wherein the feed gear is configured to move the cutting blade radially outward from the retracted position to the radially extended position in response to rotation of the cutting head in a first direction.

Statement 8. The downhole cutting tool of any preceding statement, wherein the feed gear is configured to move the cutting blade radially inward from the radially extended position to the retracted position in response to rotation of the cutting head in a second direction, wherein the second direction is opposite the first direction.

Statement 9. The downhole cutting tool of any preceding statement, further comprising a retractable anchor assembly secured to the tubular housing, wherein the retractable anchor assembly is configured to extend radially outward at a predetermined position in a wellbore to restrain movement of the tubular housing along the wellbore.

Statement 10. The downhole cutting tool of any preceding statement, wherein the at least one motor is configured to actuate to drive the retractable anchor assembly to extend radially outward in response to receiving an output from a control system.

Statement 11. The downhole cutting tool of any preceding statement, further comprising a control system disposed within the tubular housing, wherein the control system is configured to direct the at least one motor to rotate the cutting head in a first direction in response to determining that a retractable anchor assembly is disposed in a radially extended position.

Statement 12. The downhole cutting tool of any preceding statement, wherein the control system is configured to direct the at least one motor to rotate the cutting head in a second direction in response to determining that the retractable cutting blade completed cutting the downhole tubular, wherein rotating the cutting head in the second direction is configured to move the cutting blade radially inward from the radially extended position to the retracted position.

Statement 13. The downhole cutting tool of any preceding statement, wherein the control system is in communication with a surface system having a user interface, wherein the control system is configured to direct the at least one motor in response to user input via the user interface, and wherein the control system is configured to output data to the surface indicating an operational status of the downhole cutting tool.

Statement 14. The downhole cutting tool of any of statements 1-12, wherein the control system comprises an internal timer, and wherein the control system is configured to autonomously direct the at least one motor based at least in part on the internal timer.

Statement 15. The downhole cutting tool of any preceding statement, wherein the at least one motor comprises a first motor and a second motor, wherein the first motor is configured to actuate a retractable anchor assembly to deploy and retract, and wherein the second motor is configured to drive rotation of the cutting head.

Statement 16. The downhole cutting tool of any preceding statement, further comprising a gear system coupled to the second motor, wherein the second motor is configured to drive rotation of the cutting head in a clockwise direction and a counterclockwise direction via the gear system.

Statement 17. A system, comprising: a tubular housing securable to a downhole end of a conveyance; a retractable anchor assembly secured to the tubular housing, wherein the retractable anchor assembly is configured to deploy radially outward at a predetermined position in a wellbore to restrain movement of the tubular housing along the wellbore; a first motor secured within the tubular housing, wherein the first motor is configured to actuate the retractable anchor assembly to deploy and retract; a cutting head secured to the tubular housing, the cutting head having a retractable cutting blade configured to move between a radially extended position and a retracted position, and wherein the cutting head is configured to rotate with respect to the tubular housing to drive the retractable cutting blade, in the radially extended position, to cut a downhole tubular disposed in a wellbore; a second motor secured within the tubular housing, wherein the second motor is configured to drive rotation of the cutting head; and a control system configured to selectively actuate the first motor and the second motor; and a power source disposed within the tubular housing and configured to supply power to the first motor, the second motor, and the control system, and wherein the power source comprises at least one battery.

Statement 18. The system of statement 17, wherein the at least one battery comprises a plurality of alkaline batteries arranged in series and in parallel within a battery section of the tubular housing.

Statement 19. The system of statement 17 or statement 18, wherein the control system is configured to direct power output from the power source to the first motor and the second motor based at least in part on an operational status of the downhole cutting tool, wherein the control system is configured to receive voltage and current data, and wherein the control system is configured to determine the operational status of the downhole cutting tool based at least in part on the voltage and current data.

Statement 20. A method, comprising: running a downhole cutting tool into a wellbore, wherein the downhole cutting tool comprises a tubular housing, a retractable anchor assembly, a cutting head having a retractable cutting blade, at least one motor, a control system, and a power source disposed in the downhole cutting tool, and wherein the downhole cutting tool is configured to cut a downhole tubular disposed in the wellbore; deploying the retractable anchor assembly, via the at least one motor powered by the power source, at a predetermined position in the wellbore to restrain movement of the tubular housing along the wellbore; rotating the cutting head, via the at least one motor powered by the power source, in a first direction with respect to the tubular housing in response to a determination that the retractable anchor assembly is deployed at the predetermined position, wherein rotation of the cutting head moves the retractable cutting blade, via a feed gear, to a radially extended position to engage and cut the downhole tubular; rotating the cutting head in a second direction, via the at least one motor powered by the power source, to move the retractable cutting blade to a retracted position in response to a determination that the retractable cutting blade completed cutting the downhole tubular; and retracting the retractable anchor assembly to release the tubular housing to move along the wellbore in response to a determination that the retractable cutting blade is retracted.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A downhole cutting tool, comprising:

a powerless conveyance;

a tubular housing securable to a downhole end of said powerless conveyance;

a cutting head secured to the tubular housing, the cutting head having a retractable cutting blade configured to move between a radially extended position and a retracted position, and wherein the cutting head is configured to rotate with respect to the tubular housing to drive the retractable cutting blade, in the radially extended position, to cut a downhole tubular disposed in a wellbore;

at least one motor secured within the tubular housing and configured to drive rotation of the cutting head;

an onboard power source disposed within a battery cavity formed within a battery section of the tubular housing, wherein the onboard power source is configured to supply power to the at least one motor for driving rotation of the cutting head, wherein the onboard power source comprises at least one battery; and a wire passage positioned in a central portion of the battery cavity and extending axially down an entire length of the battery cavity.

2. The downhole cutting tool of claim 1, wherein the at least one motor is independently powered by the at least one battery secured within the tubular housing.

3. The downhole cutting tool of claim 1, wherein the at least one battery comprises a plurality of batteries arranged in series and in parallel within the battery section of the tubular housing.

4. The downhole cutting tool of claim 1, wherein the at least one battery comprises at least one alkaline battery, nickel metal hydride (Nimh) battery, lithium battery, or some combination thereof.

5. The downhole cutting tool of claim 1, wherein the powerless conveyance comprises a slickline.

6. The downhole cutting tool of claim 1, further comprising a feed gear disposed within the cutting head, wherein the feed gear is configured to move the cutting blade radially outward from the retracted position to the radially extended position in response to rotation of the cutting head in a first direction.

7. The downhole cutting tool of claim 6, wherein the feed gear is configured to move the cutting blade radially inward from the radially extended position to the retracted position in response to rotation of the cutting head in a second direction, wherein the second direction is opposite the first direction.

8. The downhole cutting tool of claim 1, further comprising a retractable anchor assembly secured to the tubular housing, wherein the retractable anchor assembly is configured to extend radially outward at a predetermined position in a wellbore to restrain movement of the tubular housing along the wellbore.

9. The downhole cutting tool of claim 8, wherein the at least one motor is configured to actuate to drive the retractable anchor assembly to extend radially outward in response to receiving an output from a control system.

10. The downhole cutting tool of claim 1, further comprising a control system disposed within the tubular housing, wherein the control system is configured to direct the at least one motor to rotate the cutting head in a first direction in response to determining that a retractable anchor assembly is disposed in a radially extended position.

11. The downhole cutting tool of claim 10, wherein the control system is configured to direct the at least one motor to rotate the cutting head in a second direction in response to determining that the retractable cutting blade completed cutting the downhole tubular, wherein rotating the cutting head in the second direction is configured to move the cutting blade radially inward from the radially extended position to the retracted position.

12. The downhole cutting tool of claim 10, wherein the control system is in communication with a surface system having a user interface, wherein the control system is configured to direct the at least one motor in response to user input via the user interface, and wherein the control system is configured to output data to the surface indicating an operational status of the downhole cutting tool.

13. The downhole cutting tool of claim 10, wherein the control system comprises an internal timer, and wherein the control system is configured to autonomously direct the at least one motor based at least in part on the internal timer.

14. The downhole cutting tool of claim 1, wherein the at least one motor comprises a first motor and a second motor, wherein the first motor is configured to actuate a retractable anchor assembly to deploy and retract, and wherein the second motor is configured to drive rotation of the cutting head.

15. The downhole cutting tool of claim 14, further comprising a gear system coupled to the second motor, wherein the second motor is configured to drive rotation of the cutting head in a clockwise direction and a counterclockwise direction via the gear system.

16. A system, comprising:

a powerless conveyance;

a tubular housing securable to a downhole end of the powerless conveyance;

a retractable anchor assembly secured to the tubular housing, wherein the retractable anchor assembly is configured to deploy radially outward at a predetermined position in a wellbore to restrain movement of the tubular housing along the wellbore;

a first motor secured within the tubular housing, wherein the first motor is configured to actuate the retractable anchor assembly to deploy and retract;

a cutting head secured to the tubular housing, the cutting head having a retractable cutting blade configured to move between a radially extended position and a retracted position, and wherein the cutting head is configured to rotate with respect to the tubular housing to drive the retractable cutting blade, in the radially extended position, to cut a downhole tubular disposed in a wellbore;

a second motor secured within the tubular housing, wherein the second motor is configured to drive rotation of the cutting head;

a control system configured to selectively actuate the first motor and the second motor;

an onboard power source disposed within a battery cavity formed within a battery section of the tubular housing, wherein the onboard power source is configured to supply power to the first motor for actuating the retractable anchor assembly to deploy and retract, the second motor for driving rotation of the cutting head, and the control system, and wherein the onboard power source comprises at least one battery; and a wire passage positioned within the battery cavity and extending parallel to a central axis of the tubular housing and configured to route wires which connect to the battery.

17. The system of claim 16, wherein the at least one battery comprises a plurality of alkaline batteries arranged in series and in parallel within the battery section of the tubular housing.

18. The system of claim 16, wherein the control system is configured to direct power output from the onboard power source to the first motor and the second motor based at least in part on an operational status of the downhole cutting tool, wherein the control system is configured to receive voltage and current data, and wherein the control system is configured to determine the operational status of the downhole cutting tool based at least in part on the voltage and current data.

19. A method, comprising:

running a downhole cutting tool into a wellbore using a powerless conveyance, wherein the downhole cutting tool comprises a tubular housing, a retractable anchor assembly, a cutting head having a retractable cutting blade, at least one motor, a control system, and an onboard power source, wherein the onboard power source is disposed within a battery cavity formed within a battery section of the tubular housing of the downhole cutting tool, a wire passage positioned in a central portion of the battery cavity extending axially down an entire length of the battery cavity, wherein the onboard power source comprises at least one battery, wherein the at least one motor is disposed axially between the retractable cutting blade and the onboard power source, and wherein the downhole cutting tool is configured to cut a downhole tubular disposed in the wellbore;

deploying the retractable anchor assembly, via the at least one motor powered exclusively by the onboard power source, at a predetermined position in the wellbore to restrain movement of the tubular housing along the wellbore;

rotating the cutting head, via the at least one motor powered exclusively by the onboard power source, in a first direction with respect to the tubular housing in response to a determination that the retractable anchor assembly is deployed at the predetermined position, wherein rotation of the cutting head moves the retractable cutting blade, via a feed gear, to a radially extended position to engage and cut the downhole tubular;

rotating the cutting head in a second direction, via the at least one motor powered exclusively by the onboard power source, to move the retractable cutting blade to a retracted position in response to a determination that the retractable cutting blade completed cutting the downhole tubular; and retracting the retractable anchor assembly to release the tubular housing to move along the wellbore in response to a determination that the retractable cutting blade is retracted.

* * * * *